United States Patent [19]

Bahr

[11] Patent Number: 4,570,654

[45] Date of Patent: Feb. 18, 1986

[54] COIN COUNTING APPARATUS

[76] Inventor: Adolf J. Bahr, Railway Parade, St. Lawrence, Queensland, Australia, 4707

[21] Appl. No.: 629,453

[22] Filed: Jul. 10, 1984

[30] Foreign Application Priority Data

Jul. 15, 1983 [AU] Australia ..... PG0310

[51] Int. Cl.[4] ..... G07D 9/06

[52] U.S. Cl. ..... 133/1 A

[58] Field of Search ..... 133/8 A, 8 D, 1 A, 1 R; 206/0.84, 0.82; 53/254

[56] References Cited

U.S. PATENT DOCUMENTS

| | | | |
|---|---|---|---|
| Re. 31,264 | 6/1983 | Holmes | 133/1 A |
| 2,441,486 | 5/1948 | Hagopian | 133/1 A |
| 2,697,579 | 12/1954 | Whitby | 206/0.82 X |

*Primary Examiner*—Stanley H. Tollberg

*Attorney, Agent, or Firm*—Larson and Taylor

[57] ABSTRACT

A coin counting apparatus having a resiliently deformable frame adapted to carry a plurality of stacked coins. The apparatus includes a support for the frame and an abutment for causing resilient deformation of the frame so as to carry the coins upon relative movement of the frame and the abutment.

6 Claims, 15 Drawing Figures

COIN COUNTING APPARATUS

This invention relates to a coin counting apparatus.

Hitherto coin counting apparatus as used by bank tellers and shopkeepers included a cylindrical container having a fixed volume into which coins were fed until the container was substantially filled which corresponded to a certain amount. Thus for example, the volume of the container could be such that it was substantially filled with twenty (20) twenty cent coins which correspond to an amount of four dollars. For ten cent coins the container was of smaller diameter and was suitably of a size to correspond to a dollar or two dollars worth of coins.

It has been found that usually use of such cylindrical containers in relation to a situation where rapid counting of coins was necessary was somewhat time consuming in that usually it was necessary to manually fill the containers through an open top thereof until the fixed volume was reached and then invert the container to place the fixed volume of coins into a bag or package whereby the coins could be stored in denominations of one or multiples of dollars.

It is therefore an object of the invention to provide coin counting apparatus which alleviates the abovementioned difficulties associated with the prior art.

The coin counting apparatus of the invention includes:

a resiliently deformable frame adapted to carry a plurality of coins;

support means to support said resilient frame;

abutment means for causing resilient deformation of said frame so as to carry said coins upon relative movement between said support means and said resilient frame.

The resilient frame may be of any suitable type and preferably includes one or more uprights wherein at least a pair of adjacent uprights are resiliently deformable. The resilient frame may also include cross members at each end of the frame and intermediate the height of the frame. Suitably each cross member may also be resiliently deformable.

Preferably the pair of adjacent uprights referred to above may be biassed outwardly and one way of achieving this is to bend each upright inwardly. Also it is preferred that each cross member be biassed outwardly and this may be achieved by each cross member being bent inwardly. In this particular embodiment it is preferred that the resilient frame be manufactured from spring steel or wire.

In its most preferred form the resilient frame may comprise a pair of resilient uprights and a third upright which may be also resiliently deformable. There also may be provided a pair of top cross members interconnecting each resilient upright to the rigid upright as well as a pair of bottom cross members interconnecting each resilient upright to the rigid upright. In this embodiment there will be provided an access entrance which is bounded on each side by each resilient upright.

The support means for supporting the resilient frame is preferably an elongate support housing and suitably includes a pair of opposed end walls and a pair of opposed side walls or a continuous side wall and an open top. The support housing also includes an access opening bounded by the opposed edges of the side wall.

In one form the elongate support housing may be oriented in a horizontal plane thus forming a horizontal trough and a plurality of coins making up a predetermined value may be loaded into the trough. In this embodiment the upper or surrounding edge portions of the open top of the trough may constitute an appropriate abutment means wherein the resilient frame may be located over the open top and the resilient upright of the access entrance of the resilient frame may be forced inwardly by opposed inner parts of said edge portions to engage the plurality of coins in snap fit relationship.

In another embodiment abutment means is suitably elongate and includes an abutment wall and optionally a pair of opposed side flanges. The abutment wall may be planar or arcuate.

In a preferred form of the invention the support housing is movable relative to the abutment wall although the reverse arrangement is possible if desired. To this end there may be provided a base on which both the support housing and the abutment wall is mounted. The support housing may be slidably mounted on the base and the abutment wall rigidly mounted thereto.

The base may also have an elevated boss or projection located adjacent the abutment wall.

The support housing may also comprise retaining means for retaining the resilient frame therein. In one form this may comprise a magnet located in the continuous side wall thereof which may attract the third upright of the frame described above.

Reference may now be made to a preferred embodiment of the invention as shown in the accompanying drawings wherein.

Figure 1:
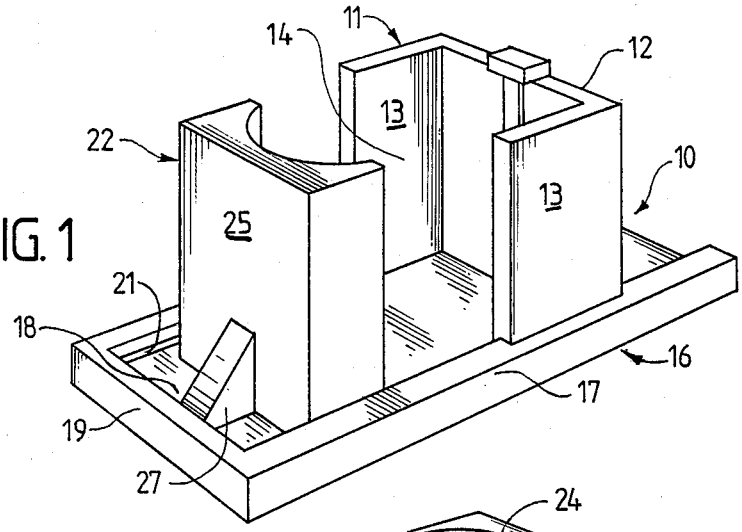
FIG. 1 is a perspective view of coin counting apparatus including an assembly comprising base, support housing and abutment wall.

In the drawings there is shown assembly 10 comprising support housing 11 having end wall 12, opposed side walls 13 and access opening 14. Base 16 includes side flanges 17 elevated above the floor 18 of base 16 and end flange 19. Support housing 11 is provided with slides 20 which engage in grooves 21 located below side flanges 17 so that housing 11 is slidably movable relative to base 16. There is also shown magnet 15 located in end wall 12 of support housing 11.

There is also shown abutment wall 22 having side surfaces 23, arcuate inner surface 24 and end surface 25. Abutment wall 22 is braced by brace 27. There is also shown elevated boss 28 located adjacent abutment wall 22.

Resilient frame 29 includes uprights 30 which are bent inwardly as shown at 31 and 32. There is also included intermediate upright 30A which also may be bent inwardly in a similar manner. There is also included top end cross members 34 which may be bent downwardly and bottom cross members 35 which may be bent upwardly so as to provide an outwardly directed bias. There may also be provided one or more intermediate cross members 36 which may rigidify frame 29. Coins 37 are shown retained within the confines of frame 29 through access entrance 38. There is also shown cradle 39 having end lugs 40, floor 41 and side flanges 39A.

Figure 7:
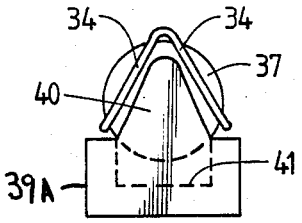
FIG. 7 is a plan view of the abutment wall and adjacent elevated boss located on the base.
Figure 8:
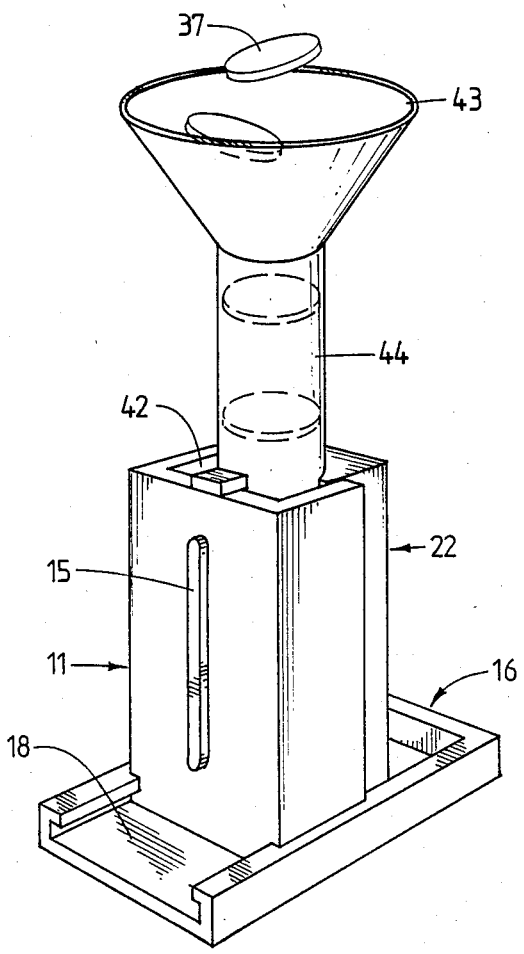
FIG. 8 shows a perspective view of the means for feeding coins into the assembly shown in FIG. 1.

The operation of the assembly shown in the drawings will now be described as particularly shown in FIGS. 7–8.

The support housing 11 is moved until it is closely adjacent abutment wall 22 to thereby form chamber 42. A funnel 43 having downwardly extending tube 44 is then oriented so that tube 44 extends within the confines of chamber 42. Coins 37 are then passed into chamber 42 through tube 44. Resilient frame 29 has already been placed in chamber 42 adjacent tube 44 with upright 30A being located adjacent magnet 15 which ensures that frame 29 assumes an upright orientation. When coins 37 reach the height of frame 29 the funnel 43 is removed. The pile of coins is supported by elevated boss 28.

Figure 3:
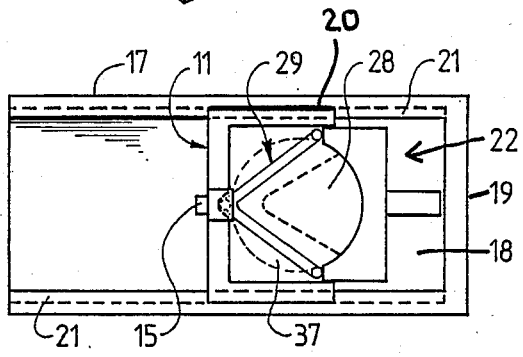
FIG. 3 is a plan view of the assembly shown in FIG. 1.
Figure 4:
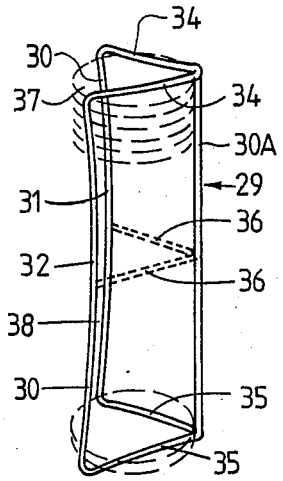
FIG. 4 is a perspective view of the resilient frame.
Figure 5:
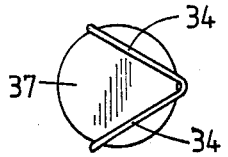
FIG. 5 is a plan view of the frame shown in FIG. 4.
Figure 6:
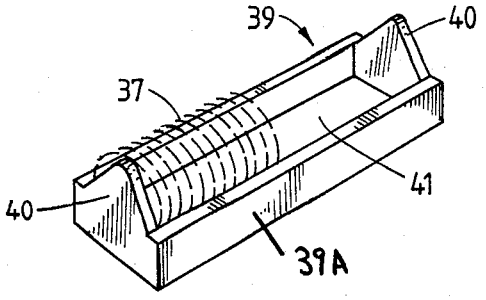
FIG. 6 is a perspective view of the cradle.

When funnel 43 is removed from chamber 42 support housing 11 is then moved closer to abutment wall 22 until finally a position is reached in relation to abutment wall 22 as indicated in FIG. 3. The provision of elevated boss 28 allows bottom frame members 35 of frame 29 to surround the lowermost coin but be located below it. The continued movement of housing 11 and associated frame 29 relative to abutment wall 22 causes the uprights 30 to bend outwardly so that the frame 29 may surround the pile of coins which enter the interior of frame 29 through access entrance 38. Upon relaxation or retraction of uprights 30 the pile of coins is then securely retained within frame 29. Frame 29 is then removed from assembly 10 and placed in cradle 39.

It will be appreciated that the apparatus of the invention can be used for counting and sorting of coins on a rapid basis and is more efficient in operation than the prior art described above.

Figure 9:
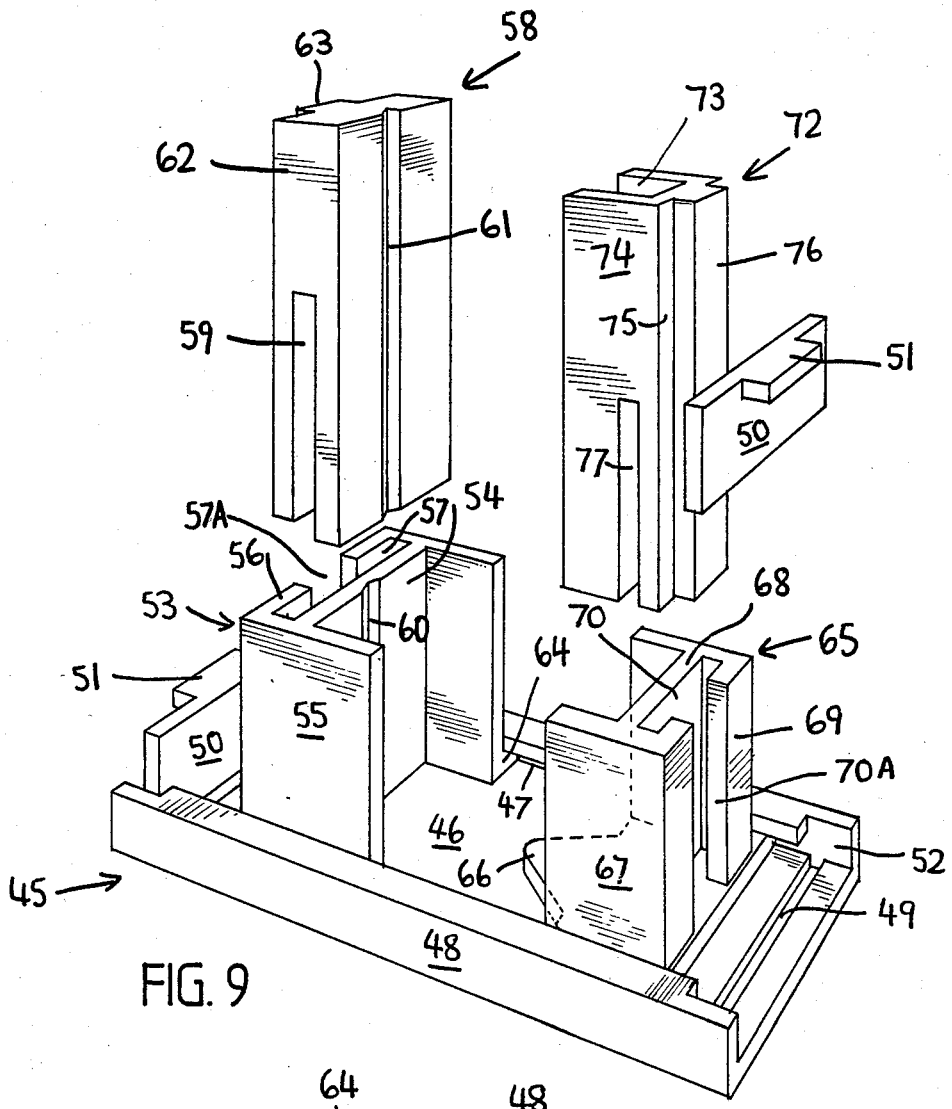
FIG. 9 is an alternative embodiment showing coin counting apparatus including an assembly comprising base, support housing and abutment wall.
Figure 10:
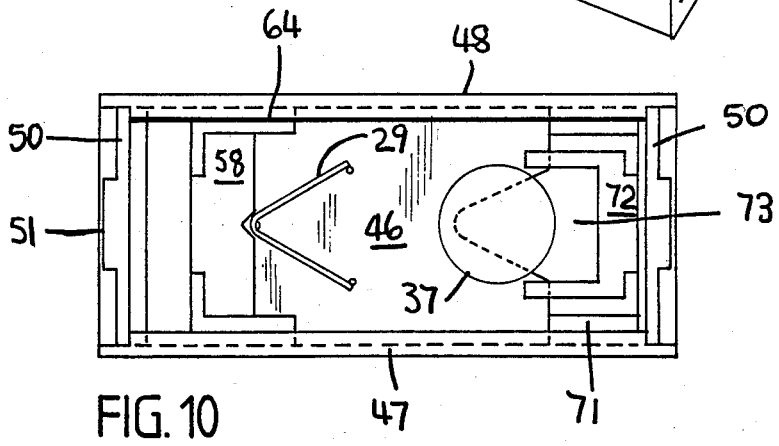
FIG. 10 is a top plan view of the assembly shown in FIG. 9.

In the embodiment shown in FIGS. 9–10 there is shown base 45 having floor or base surface 46 together with keyways or grooves 47 and side flanges 48. There is also shown grooves 49 for locking plates 50 having end tabs 51. Each plate 50 may be accommodated within a retaining recess 52 of base 45. There is also shown abutment block 53 having abutment wall 54, side walls 55 and end walls 56. There is also provided recess or slot 57 having entrance position 57A. Also illustrated is abutment insert 58 having base slot 59 for engaging with abutment wall 54 as shown in FIG. 9. Abutment wall 54 is provided with coin retaining groove 60 as well as abutment insert 58 which has body part 62 and end projection 63 which engages with slot 57A. Abutment block 58 has slides 64 which engage in an associated groove 47. There is also shown support block 65 having coin retaining boss 66, side walls 67, intermediate wall 68 and end walls 69. Also shown is recess or slot 70 having entrance portion 70A. Support block 65 also has slides 71 which engage with grooves 47. Also shown is insert 72 having inner coin retaining slot 73, side walls 74 and end wall 75 having projection 76 which engages with recess 70A as shown. Wall 68 of support block 65 engages in slot 77 of insert 72 as shown.

Figure 2:
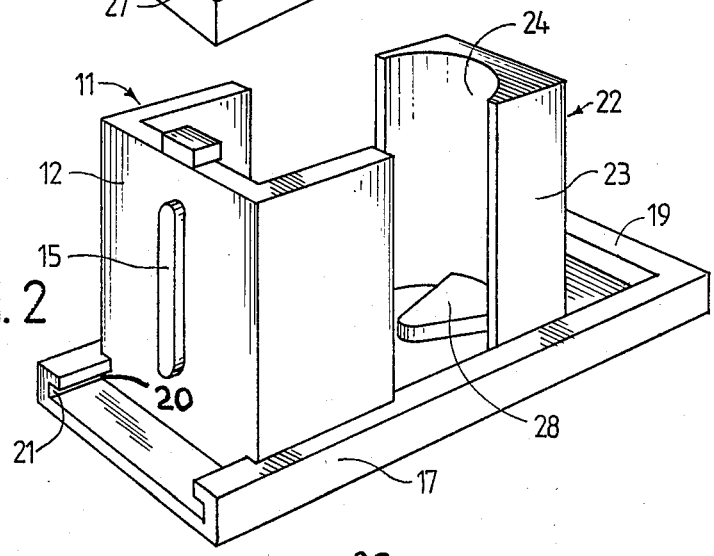
FIG. 2 is a perspective view of the assembly of FIG. 1 from an opposite side.

The assembly shown in FIGS. 9–10 operates in a similar manner to that shown in FIGS. 1–3 with coins 37 as shown in FIG. 10 being retained within recess 73 of insert 72 and supported by raised boss 66. Resilient frame 29 is retained within groove 61 of abutment insert 58 as shown and upon engagement of coins 37 with frame 29 they are snapped or clipped into the confines of frame 29 and hold therein as shown in FIGS. 1–3. Inserts 58 and 72 are useful for providing a coin height equivalent to a predetermined value and may be dispensed with if required. Support housing 65 may be used for coins of larger diameter and in this case frame 29 engages with groove 60 of abutment housing 53.

Figure 11:
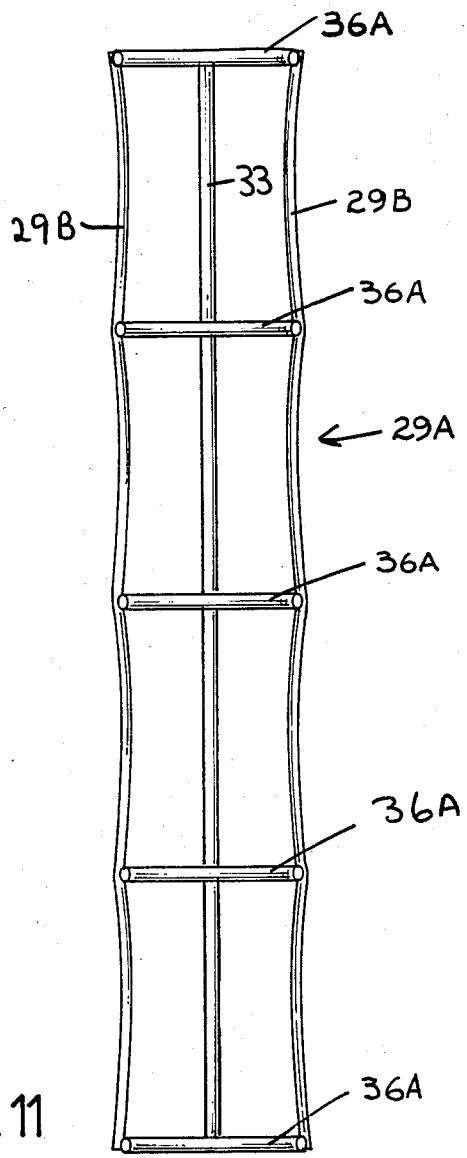
FIG. 11 is a view of an alternative type of resilient frame to that shown in FIGS. 4–5.
Figure 12:
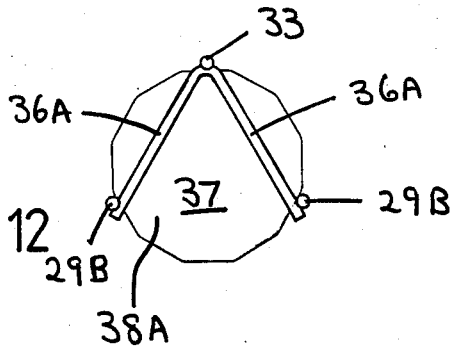
FIG. 12 is a top plan view of the resilient frame shown in FIG. 11.

In FIGS. 11–12 there is shown resilient frame 29A having intermediate upright 33 end uprights 29B and access entrance 38A. Also shown are cross members 36A. Each upright 29B is curved inwardly between adjacent cross members 36A as shown.

Figure 13:
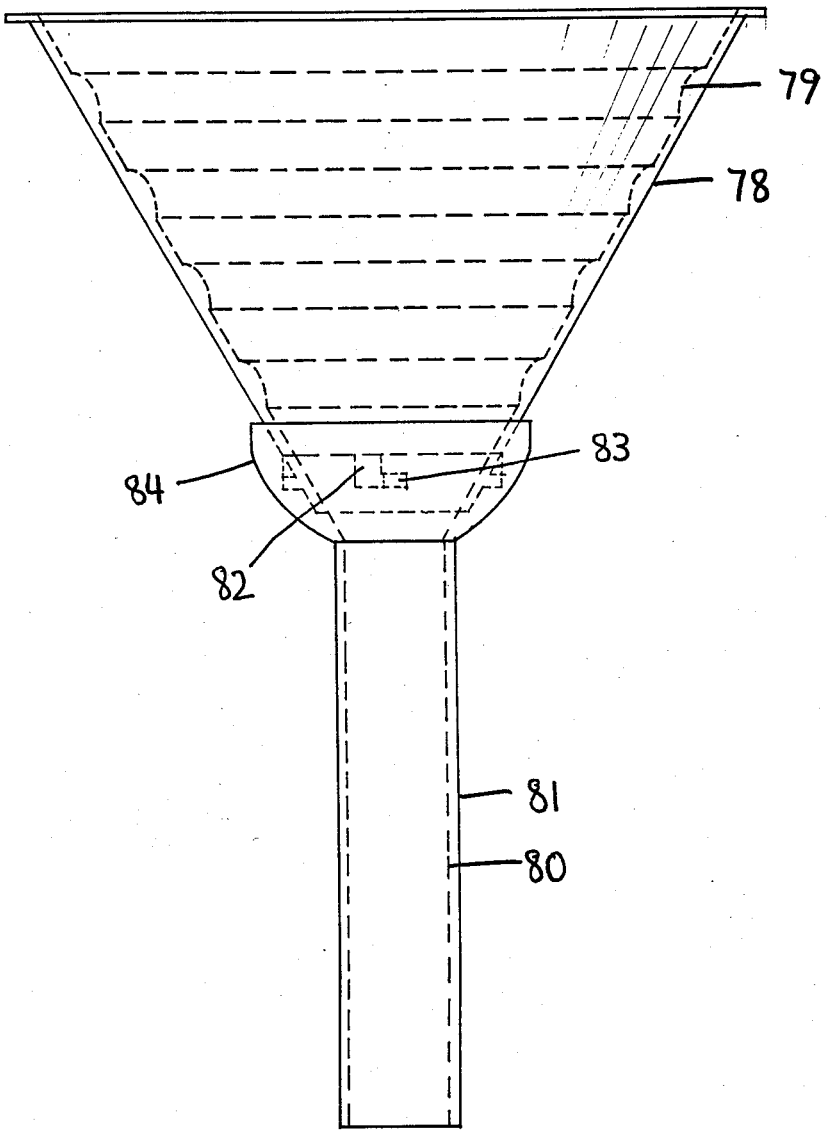
FIG. 13 is a view of a suitable loading apparatus for loading the abovementioned support housing or of the assembly of FIGS. 1 or 9.

In FIG. 13 there is shown funnel 78 having interior ribs 79 and base tube 80. Funnel 78 may be universal in operation and be used with coins of varying sizes corresponding to a particular coin retaining tube 81 which corresponds to a specific coin diameter. Funnel 78 may have bayonet projections 83 which engage with bayonet sockets 82 of tube 81. Tube 81 may also be provided with enlarged bowl like end part 84 having sockets 82. Ribs 79 are provided for ensuring that coins may pass into tube 81 in a horizontal orientation and thus inhibits jamming of coins.

Figure 14:
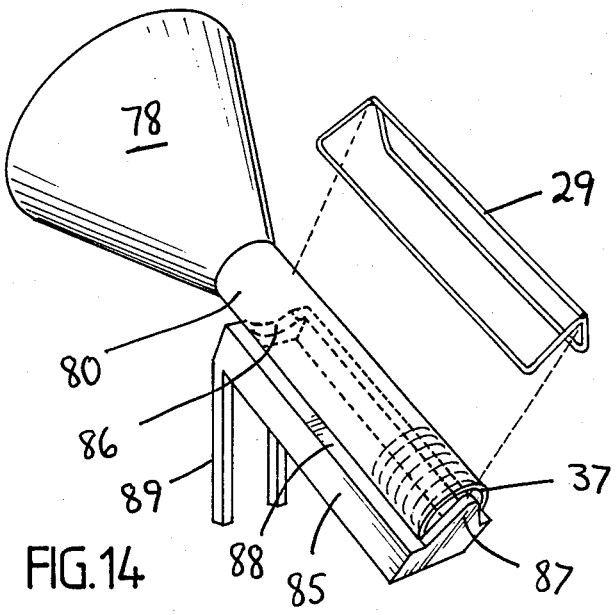
FIG. 14 is a perspective view of a horizontal trough or cradle being loaded by the apparatus of FIG. 13.
Figure 15:
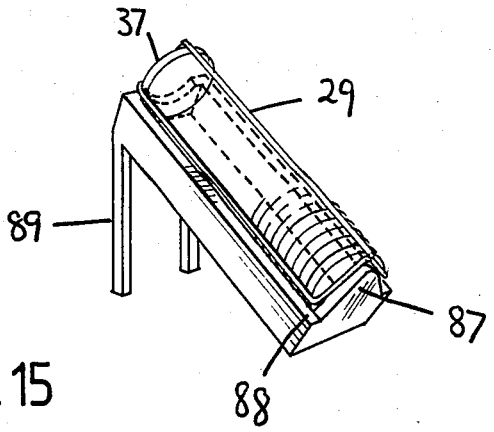
FIG. 15 is a perspective view of the cradle of FIG. 14 loaded with coins and retained within a resilient frame as described in FIG. 4 or 11.

In FIGS. 14–15 in an alternative embodiment in accordance with the invention funnel 78 may be used to load cradle of horizontal trough 85 as shown with coins 37. In this embodiment cradle 85 may be provided with arcuate recess 86 for locating tube 80 of funnel 78 within cradle 85 which is then retained in position by end retaining lug 87. Resilient frame 29 may then be held in position above tube 80 which may then be withdrawn while frame 29 is snapped in position about the pile of coins 37 wherein in this case edge portions 88 of cradle 85 may provide suitable abutment means for this purpose and in particular the inner parts of edge portions 88. Cradle 85 may also be provided with feet 89 so as to provide an inclined position when supporting funnel 78.

I claim:

1. Coin counting apparatus including:

a resiliently deformable frame adapted to support a plurality of coins;

support means for supporting the resilient frame; abutment means for causing resilient deformation of said frame upon relative movement between the resilient frame and said abutment means so that said frame provides support for said coins, said support means including an elongate support housing having a continuous side wall and an access opening located within said wall, and said abutment means including an abutment wall wherein said resilient frame may be located within said support housing and said plurality of coins located adjacent the abutment wall, whereby with relative movement between the support housing and abutment wall, said resilient frame may engage said plurality of coins in snap fit relationship.

2. Coin counting apparatus as claimed in claim 1 wherein one of the abutment wall and the support housing is slidably mounted on a support base.

3. Coin counting apparatus as claimed in claim 2 wherein both the abutment wall and the support housing are slidably mounted on said support base.

4. Coin counting apparatus as claimed in claim 1 wherein the resilient frame includes a plurality of uprights including at least two uprights which are spaced from each other to define an access entrance.

5. Coin counting apparatus as claimed in claim 4 wherein there is provided a plurality of cross members interconnecting each upright including a top cross member and bottom cross member.

6. Coin counting apparatus as claimed in claim 4 wherein at least each upright bounding said access entrance is biassed outwardly.

* * * * *